United States Patent [19]

Carre

[11] Patent Number: 4,686,837

[45] Date of Patent: Aug. 18, 1987

[54] PERSONAL DECORATION RETAINER

[76] Inventor: Graham J. Carre, Sunset Cottage, Franc Fief Lane, St. Sampsons, Guernsey, Channel Islands

[21] Appl. No.: 810,986

[22] Filed: Dec. 19, 1985

[30] Foreign Application Priority Data

[GB] United Kingdom .....

[51] Int. Cl.[4] ..... A44C 7/00; A44B 9/00

[52] U.S. Cl. ..... 63/12; 24/155 C

[58] Field of Search ..... 63/12, 13; 24/106, 155 R, 24/155 A, 155 BB, 155 RB, 155 C, 155 CC

[56] References Cited

U.S. PATENT DOCUMENTS

| | | | |
|---|---|---|---|
| 396,788 | 1/1889 | Washburn | 63/13 |
| 1,235,622 | 8/1917 | White | 24/155 RB |
| 1,358,465 | 11/1920 | Reston | 24/155 C |

FOREIGN PATENT DOCUMENTS

| | | | |
|---|---|---|---|
| 3002522 | 1/1980 | Fed. Rep. of Germany . | |
| 638558 | 2/1928 | France | 63/12 |
| 741157 | 12/1932 | France | 63/12 |

*Primary Examiner*—Richard J. Johnson

*Attorney, Agent, or Firm*—Renner, Otto, Boisselle & Lyon

[57] ABSTRACT

A retainer, for supporting a decorative article such as an ear-ring, a brooch or a lapel badge on the person, has a pin member and a fastening device separably connectable thereto. The fastening device includes an elongate housing with opposed side walls and, intermediate those side walls, has aperture means through which the pin member can pass with clearance. A spring clip is disposed within said housing and abuts the opposed side walls and grips the pin member passing through the aperture means thereby frictionally holding the pin member releasably in the housing.

20 Claims, 3 Drawing Figures

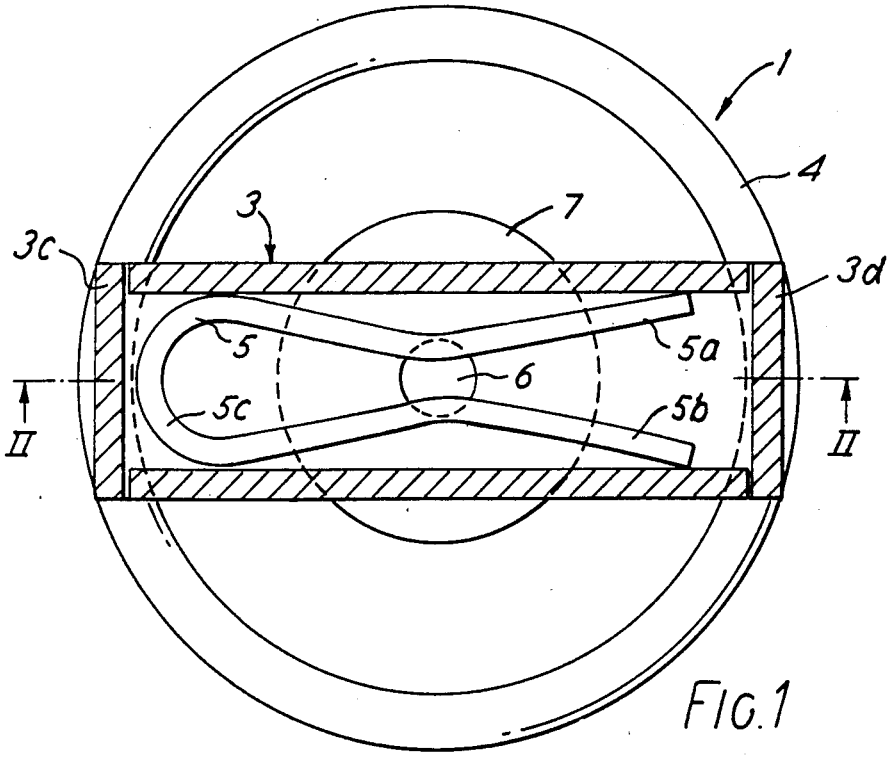
FIG. 1
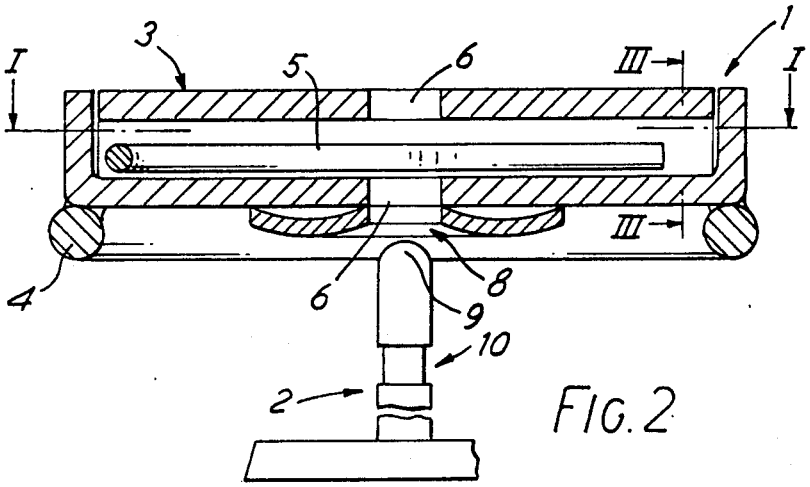
FIG. 2
FIG. 3
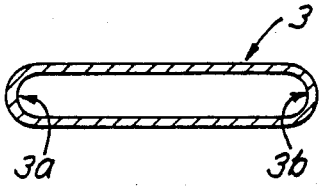

PERSONAL DECORATION RETAINER

BACKGROUND OF THE INVENTION

This invention relates to a retainer for supporting a decorative article on the person, and particularly for application to a pierced ear-lobe as in an ear-ring, or for engagement through an article of clothing as in a brooch or a lapel badge or the like.

It is well known to support a decorative article, especially a piece of jewellery, on the person by means of a retainer comprising a pin member carrying said article and a fastening device separably connectable to the pin member. In the case of ear-rings, for pierced ear lobes, one common form of retainer has a threaded pin member and the fastening device is provided with a cooperatingly threaded bore permitting said device to be screwed onto the pin to retain the ear-ring in place. Another common form of ear-ring retainer has a pin member which is not threaded and the fastening device is in the form of a so-called "butterfly", being a plate with a hole for slidably receiving the pin member and having resiliently deformable means to frictionally engage a portion of the pin extending through said hole. Usually, the said resiliently deformable means is provided by curling opposite end portions of the plate rearwardly, to provide opposed wings between which the pin member is gripped.

German Offenlegungsschrift (OLS) No. 3002522 published July 30, 1981 discloses a jewellery retainer comprising a pin member and a "butterfly" fastening device in which the fastening device includes a spring clip for gripping the pin member. This fastening device consists of four parts, namely the spring clip, an inner disc, a locating disc, and a cover disc. The inner disc is dished and contains the spring; the locating disc overlays the spring within the inner disc; and the cover disc also is dished and fits over the inner disc to close that disc and to retain the locating disc, and hence the spring clip, in place. Aligned apertures are provided in the discs to receive the pin member. The spring clip has a hairpin-like clip portion for gripping the pin member, said portion extending radially inwardly from, and being located by, an annular portion abutting the side walls of the dished inner disc.

The fastening device of OLS No. 3002522 is an improvement over the conventional butterfly fastening device but is of relatively complex construction and hence significantly more expense to manufacture. Further, all four component parts of the German device must be manufactured to relatively close tolerances to ensure alignment of the apertures and correct location of the spring clip relative to the apertures. Moreover, the German device is relatively bulky and heavy compared with the conventional butterfly fastening device.

OBJECTS OF THE INVENTION

A primary object of the invention is to provide a retainer comprising a pin member separably held in a fastening device by friction resulting from deformation of a spring clip, in which the fastening device is of less complex construction than that of OLS No. 3002522 and further can be of smaller dimensions and less weight than that of OLS No. 3002522.

SUMMARY OF THE INVENTION

According to the present invention there is provided a retainer, for supporting on the person a decorative article such as an ear-ring, brooch, lapel badge or the like, which retainer comprises a pin member and a fastening device separably connectable thereto, the fastening device including an elongate housing having opposed side walls and having intermediate said side walls, aperture means through which said pin member can pass with clearance, and a spring clip located in said housing and having legs abutting said opposed side walls to grip the pin member passing through said aperture means thereby frictionally holding the pin member releasably in the housing.

Advantageously the housing is tubular, with or without a longitudinal seam or break, and is of flattened cross-section so that said opposed side walls are walls of minor dimensions and are connected to opposed walls of major dimensions, the aperture means being provided by aligned holes in both of said walls of major dimensions.

Preferably, the spring clip is a hairpin-shaped spring. Such a spring is elongate and generally U-shaped having its legs bowed towards each other to provide a gripping portion. The spring may, for example, comprise a bridge portion connecting the two legs, the bridge portion and the free end of each leg portion, in the rest condition, all abutting the opposed side walls.

In a convenient form of construction, and for example to ensure that the spring clip is maintained within the housing, the housing includes end flaps, on the respective ends of one at least of the major walls, bent up so as to overlie the ends of the housing.

Guide means may be provided on the housing and disposed about the aperture means so as to be contacted by the pin member, during insertion of the pin member into the housing, and thereby guide said pin member into the aperture means. The guide means may be, for example, a cup secured externally on the housing and having its wall inclined towards an opening in the guide cup aligned with the aperture means.

Further according to the invention there is provided an article of personal decoration, especially jewellery, incorporating a retainer of the kind described hereinabove.

BRIEF DESCRIPTION OF THE DRAWINGS

An embodiment of a retainer for a personal decoration, in accordance with the invention, is shown in the accompanying drawings.

In the drawings:

FIG. 1 is a transverse section of a fastening device of the retainer, taken on the line I—I of FIG. 2;

FIG. 2 is a transverse section of the fastening device of the retainer, taken on the line II—II of FIG. 1, and including an elevation of part of a pin member of the retainer;

FIG. 3 is a scrap section, taken on the line III—III of FIG. 2, and on a different scale to show the nature of a flattened tubular housing of the fastening device.

DESCRIPTION OF THE PREFERRED EMBODIMENT

The fastening device of the retainer, designated generally by reference numeral 1, is adapted to cooperate with a pin member designated generally by the reference numeral 2 and carrying a decorative article.

The fastening device 1 comprises a tubular housing 3 which is mounted diametrically across a ring 4. The ring 4 is shown purely by way of example, and any other member appropriate to the use of the retainer could be secured on the housing 3, or the housing 3 could be used alone without any other member attached to it.

The housing 3 is constituted by a length of flattened tube of generally oval cross-section, as seen in FIG. 3. The tube could be seamless, as illustrated, or could have a longitudinal split to permit it to be formed up from flat sheet.

Within the internal space of the housing 3 there is disposed a hairpin-shaped spring 5. The legs 5*a*, 5*b* of the spring are connected by a central bridging portion 5*c*. The width of the central bridging portion 5*c* is such as to make the spring a snug fit, in contact or near contact, within the inner side wall surfaces 3*a*, 3*b* of the housing 3. The curvature or bowing inwardly of the legs 5*a*, 5*b* is such that they are most closely approached approximately centrally along their length, adjacent to apertures 6 provided correspondingly in the opposed major wall surfaces of the housing 3. The free end of each leg 5*a* and 5*b* abuts firmly against the respective inside wall surfaces 3*a* and 3*b*.

In one manner of manufacture of the housing 3 with the spring 5 disposed within it, the end flaps 3*c*, 3*d* of the housing 3 are initially left as longitudinally extended flaps, to permit the spring 5 to be slid into the housing whereafter the end flaps 3*c*, 3*d* are bent up to the configuration shown in FIG. 2.

On the outer surface of the housing 3 there is secured an annular guide cup 7 having a central opening 8 of at least the same diameter as the apertures 6. The outer surface of the guide cup is curved and inclined in such a manner as to guide the rounded free end 9 of the pin 2 readily into the aperture 6, thereby to facilitate assembly of the pin 2 to the fastening device 1.

In use, the pin 2 is pushed into contact with the guide cup 7 and through the adjacent aperture 6, so as to make contact with the central portion of the spring legs 5*a*, 5*b*. With continued entering movement, the rounded end 9 of the pin 2 forces the spring legs apart, until the pin has passed between the legs and out through the other of the apertures 6.

As the pin 2 is forced between the legs 5*a*, 5*b*, the legs are sprung outwardly and, because they are already in contact with the inside wall surface of the housing 3, their movement outwardly is restricted and they are forced to deform by bowing outwardly, thereby giving a very firm frictional engagement on the pin 2. The pin is thus held in assembly with the fastening device 1, sufficiently firmly to enable the retainer to secure an article of decoration, jewellery, and ear-lobe embellishment or the like, whilst nevertheless being readily removable manually when required. The grip exerted by the spring 5 on the pin 2 may be made sufficient to hold the pin 2 firmly at any desired degree of axial insertion of the pin 2, but if a more positive locking engagement is required, the pin 2 may have one or more circumferential recesses 10 into which the spring legs can snap when the pin has been inserted.

It will be appreciated that the invention is not restricted to the particular details described above but that numerous modifications and variations can be made without departing from the scope of the invention as defined in the following claims. In particular, the decorative article could be carried by the fastening device instead of by the pin member. For example, in an earring for non-pierced ears, the decorative article could be connected to the fastening device by a U-shaped member receiving the ear lobe and the pin member provided with a disc for clamping against the ear lobe to secure the ear-ring thereto.

I claim:

1. A retainer, for supporting a decorative article on the person, comprising a pin member and a fastening device separably connectable thereto, the fastening device including an elongate tubular housing having opposed side walls and having intermediate said side walls aperture means through which said pin member can pass with clearance, and an elongate generally U-shaped spring clip located in said housing and having legs abutting said opposed side walls and bowed towards each other to provide a gripping portion to grip the pin member passing through said aperture means thereby frictionally holding the pin member releasably in said housing.

2. The retainer according to claim 1, in which said housing is of flattened cross-section so that said opposed side walls are walls of minor dimensions and are connected by opposed walls of major dimensions, said aperture means being provided by aligned holes in both of said walls of major dimensions.

3. The fastening device according to claim 1, in which at least one end of said tubular housing is effectively closed by deforming a respective end portion of said housing for maintaining the spring clip in said housing.

4. The retainer according to claim 1, in which said spring comprises a bridge portion connecting said legs, said bridge portion and the free end of each said leg portion, in the rest condition, all abutting said opposed side walls.

5. The retainer according to claim 1, in which said tubular housing includes end flaps, on the respective ends of one of said major walls, bent up to overlie the ends of the housing.

6. The retainer according to claim 1, in which guide means are provided on said housing disposed about said aperture means to be contacted by the pin member, during insertion of the pin member, and guide said pin member into said aperture means.

7. The retainer according to claim 6, in which said guide means is a cup secured on said housing and having a wall inclined towards an opening aligned with said aperture means.

8. An article of personal decoration incorporating a retainer as claimed in claim 1.

9. An earring incorporating a retainer as claimed in claim 1.

10. The retainer according to claim 1, in which the ends of said tubular housing are closed after insertion of the spring clip.

11. A fastening device for separable connection to a pin member of an earring, said device including an elongate tubular housing having opposed side walls and having intermediate said side walls aperture means through which the pin member can pass with clearance, and an elongate generally U-shaped spring clip located in said housing and having legs abutting said opposed side walls and bowed towards each other to provide a gripping portion to grip the pin member passing through said aperture means thereby frictionally holding the pin member releasably in said housing.

12. The fastening device according to claim 11, in which said housing is of flattened cross-section so that said opposed side walls are walls of minor dimensions and are connected by opposed walls of major dimensions, said aperture means being provided by aligned holes in both of said walls of major dimensions.

13. The fastening device according to claim 11, in which said spring comprises a bridge portion connecting said legs, said bridge portion and the free end of each said leg portion, in the rest condition, all abutting said opposed side walls.

14. The fastening device according to claim 11, in which said tubular housing includes end flaps, on the respective ends of one of said major walls, bent up to overlie the ends of the housing.

15. The fastening device according to claim 11, in which the ends of said tubular housing are closed after insertion of the spring clip.

16. The fastening device according to claim 11, in which guide means are provided on said housing disposed about said aperture means to be contacted by the pin member, during insertion of the pin member, and guide the pin member into said aperture means.

17. The fastening device according to claim 16, in which said guide means is a cup secured on said housing and having a wall inclined towards an opening aligned with said aperture means.

18. The fastening device according to claim 11, in which at least one end of said tubular housing is effectively closed by deforming a respective end portion of said housing for maintaining the spring clip in said housing.

19. The fastening device according to claim 18, in which both ends of said tubular housing are closed by deforming respective end portions of said housing sufficiently to maintain the spring clip in said housing.

20. A retainer, for supporting a decorative article on the person, comprising a pin member and a fastening device separably connectable thereto, the fastening device including an elongate housing having opposed side walls and having intermediate said side walls aperture means through which said pin member can pass with clearance, and a spring clip located in said housing and having legs abutting said opposed side walls to grip the pin member passing through said aperture means thereby frictionally holding the pin member releasably in said housing, said housing being tubular and of flattened cross-section so that said opposed side walls are walls of minor dimensions and are connected by opposed walls of major dimensions, said aperture means being provided by aligned holes in both of said walls of major dimensions, and said tubular housing including end flaps, on the respective ends of one of said major walls, bent up to overlie the ends of the housing.

* * * * *